United States Patent [19]

Skala

[11] 4,291,378

[45] Sep. 22, 1981

[54] STEAM POWER PLANT AND CONTROL ELEMENT FOR THE PLANT

[75] Inventor: Karel Skala, Windisch, Switzerland

[73] Assignee: BBC Brown, Boveri & Co., Ltd., Baden, Switzerland

[21] Appl. No.: 21,309

[22] Filed: Mar. 16, 1979

[30] Foreign Application Priority Data

Mar. 21, 1978 [CH] Switzerland ..... 3057/78

[51] Int. Cl.[3] ..... F01D 19/00; F01D 17/00

[52] U.S. Cl. ..... 364/494

[58] Field of Search ..... 364/494; 60/644, 661–663, 60/706; 415/17, 13

[56] References Cited

U.S. PATENT DOCUMENTS

| | | | |
|---|---|---|---|
| 3,348,559 | 10/1967 | Brothman et al. | 364/494 X |
| 3,552,872 | 1/1971 | Giras et al. | 364/494 X |
| 3,561,216 | 2/1971 | Moore, Jr. | 364/494 X |
| 4,005,581 | 2/1977 | Aanstad | 364/494 X |
| 4,007,595 | 2/1977 | Braytenbah et al. | 364/494 X |
| 4,007,597 | 2/1977 | Jaegtnes et al. | 364/494 X |
| 4,028,532 | 6/1977 | Reuther | 364/494 |
| 4,088,875 | 5/1978 | Prodolsky et al. | 364/494 |

*Primary Examiner*—Edward J. Wise

*Attorney, Agent, or Firm*—Burns, Doane, Swecker & Mathis

[57] ABSTRACT

A steam turbine plant is disclosed having at least one turbine intake valve and at least one by-pass valve, which valves are connected with a live-steam generator by way of a live-steam supply system. A regulating circuit is provided to control the opening or respectively closing motion of the turbine intake valve and/or the by-pass valve, where the regulating circuit is designed in such manner that it will supply each valve with one electrical regulating value ($x_1$, $x_2$) which will act upon the respective controlled system. The electrical regulating value is provided so as to attain a specific steam flow-through ($Q_1$, $Q_2$), representing the controlled variable. The controlled systems each comprise a valve to be regulated. The controlled systems differ from each other in particular features in that there is placed within the controlled system containing the turbine intake valve and/or the by-pass valve at least one correction element which possesses such transfer function that the transfer functions of both controlled systems will be, at least in approximation, identical with each other.

12 Claims, 2 Drawing Figures

STEAM POWER PLANT AND CONTROL ELEMENT FOR THE PLANT

BACKGROUND AND SUMMARY OF THE PRESENT INVENTION

The present invention relates to a steam turbine plant having at least one turbine intake valve and at least one by-pass valve which valves are connected with a live-steam generator by way of a live-steam supply system. A regulating circuit is provided to control the opening or the closing motion of the turbine intake valve and/or the by-pass valve. The regulating circuit is arranged so that it will supply each valve, for the purpose of attaining a specific steam flow-through (the controlled variable), with one electrical signal at a regulating value which acts upon the respective controlled system comprising the valve to be regulated with both of the controlled systems differing from each other in design.

A contractor supplying reactors for nuclear power plants typically specifies that the sum $Q_1(t)+Q_2(t)$ for the steam flow-through will remain, at least approximately, constant. This requirement can be met relatively easily in the case of slow changes of the valve openings controlling the flow-through. In the case of rapid reductions in power, however, so-called fast valving, which fast valving is necessary for example in the event of a short circuit or stroke of lightning in one section of the associated network, the turbine intake and by-pass valves must provide very rapid changes in steam flow in opposed directions.

The duration of such fast valving is determined in principle by a known circuit arrangement where $x_1$ and $x_2$ represent the electrical signal regulating values for a turbine intake valve and by-pass valve. This is expressed by the formula $$x_2(t)=x_3(t)-x_1(t) \tag{1.1}$$

where $x_3$ is the output signal from a pressure governor, and $x_3(t)$ is, at least approximately, constant. Therefore:

$$\Delta x_2(t)=-\Delta x_1(t) \tag{1.2}$$

and $\Delta Q_2(t)$ should, at least approximately, equal $-\Delta Q_1(t)$.

There exist the transfer functions $$F_1(s)=\frac{\Delta Q_1(s)}{\Delta x_1(s)} \text{ and } F_2(s)=\frac{\Delta Q_2(s)}{\Delta x_2(s)},$$

which are rather complicated and which are not equal due to dissimilar oil systems, servomotors, valves, flow-through conditions, steam pressures, etc. Since $F_1(s)\neq F_2(s)$ and since $\Delta x_2(s)=-\Delta x_1(s)$, then $\Delta Q_2(s)\neq-\Delta Q_1(s)$ even though $\Delta Q_2(t\rightarrow\infty)\approx-\Delta Q_1(t\rightarrow\infty)$, which means that it was not possible heretofore to lower the turbine output upon receipt of a fast valving signal from circuitry within an appropriate time period (approximately one second) to a lesser output value, (for example 35% of the original output) and still meet the requirement of the contractor supplying the nuclear reactor. This requirement being that $Q_1(t)+Q_2(t)$ be kept, at least approximately, constant.

Accordingly, it is an object of the present invention to provide a steam turbine plant which is free of the above-discussed disadvantageous features.

A steam turbine plant according to the present invention includes a controlled system having a turbine intake valve and/or a by-pass valve with at least one correction element being arranged according to such a transfer function that the transfer functions of both controlled systems will be, at least approximately, identical with each other.

It is especially advantageous to arrange the correction element within the controlled system which comprises the by-pass valve.

It is still further advantageous if the transfer function ($F_{KOR}(s)$) of the correction element follows the formula $$F_{KOR}(s)=\frac{F_1(s)}{F_2(s)}$$

$$\text{where } F_1(s)=\frac{Q_1(s)}{x_1(s)} \text{ and } F_2(s)=\frac{Q_2(s)}{x_2(s)},$$

and where $F_1(s)$ represents the transfer function of the controlled system containing the turbine intake valve, $x_1$ the regulating value acting within this regulating system, $F_2(s)$ the transfer function of the controlled system comprising the by-pass valve, $x_2$ the regulating value acting within the last-mentioned system, $Q_1$ the steam flow through the turbine intake valve, $Q_2$ the steam flow through the by-pass valve, and s the complex variable.

BRIEF DESCRIPTION OF THE DRAWINGS

A preferred embodiment of the present invention is described with reference to the accompanying drawings wherein like members bear like reference numerals and wherein.

DETAILED DESCRIPTION OF THE PREFERRED EMBODIMENT

Figure 1:
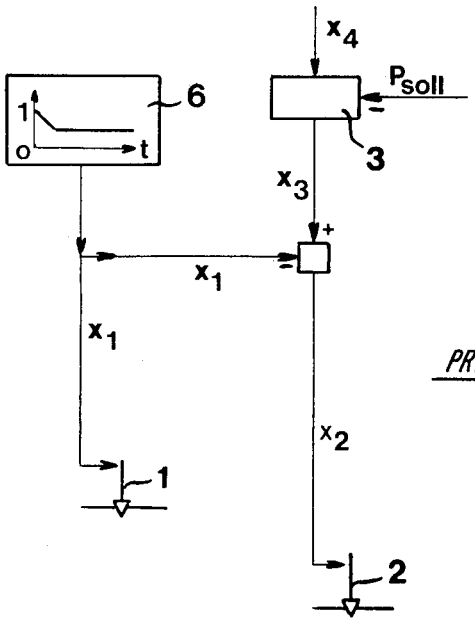
FIG. 1 PRIOR ART
FIG. 1 is a schematic illustration of a known regulating circuit for the control of a turbine intake and/or by-pass valve.

As described above, a known circuit arrangement with reference to FIG. 1 for a turbine includes a turbine intake valve 1 and a by-pass valve 2. Electrical regulating values for the valves 1 and 2 are represented by $x_1$ and $x_2$ and the values are expressed by the formula $$x_2(t)=x_3(t)-x_1(t) \tag{1.1}$$

where $x_3$ is the output signal from a pressure governor 3. The symbol $p_{soll}$ is a desired value of live-steam pressure within a live-steam supply system for the turbine. The symbol $x_4$ is an electrical signal representing the actual value of the live-steam pressure with $x_3(t)$ being at least approximately constant. Accordingly:

$$\Delta x_2(t)=-\Delta x_1(t) \tag{1.2}$$

with $\Delta Q_2(t)$ being at least approximately equal to $-\Delta Q_1(t)$.

Transfer functions can be formulated as follows:

$$F_1(s) = \frac{\Delta Q_1(s)}{\Delta x_1(s)} \text{ and } F_2(s) = \frac{\Delta Q_2(s)}{\Delta x_2(s)}$$

with $F_1(s) \neq F_2(s)$ as a result of dissimilar oil systems, servomotors, valves, flow-through conditions, steam pressures, etc. In this way, since $\Delta x_2(s) = -\Delta x_1(s)$, $\Delta Q_2(s) \neq -\Delta Q_1(s)$ even though $\Delta Q_2(t \to \infty) \approx -\Delta Q_1(t \to \infty)$. Therefore it was not possible in the known systems to lower the turbine output upon the receipt of a fast valving signal from circuitry 6 within an appropriate time period. An appropriate time period to lower the turbine output to a lesser value (for example to 35% of the original output) while still meeting the requirement that $Q_1(t)+Q_2(t)$ remain about constant, is about one second.

Figure 2:
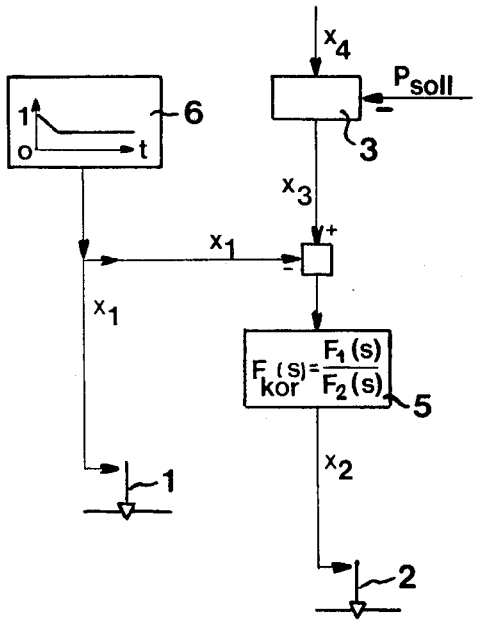
FIG. 2 is a schematic illustration of a regulating circuit according to the present invention for the control of a turbine intake and/or by-pass valve.

With reference now to FIG. 2, a regulating circuit according to the present invention for the control of the opening or respectively closing motion of the turbine intake valve 1 and the by-pass valve 2 is designed so that it will deliver to each of the two valves 1 and 2 an electrical regulating value $x_1$ or $x_2$ respectively. The value $x_1$ or $x_2$ accordingly attains a specific steam flow-through $Q_1$ or $Q_2$ or respectively a live-steam pressure p in accordance with the controlled variable, with the regulating values each influencing one controlled system which contains the valve to be controlled. The circuit consists of electrical elements, a hydraulic control system, servomotors and the like, and the two controlled systems differ from each other in specific arrangement.

In contrast to the known arrangement illustrated in FIG. 1, the arrangment according to the present invention includes a correction element 5 which is located within the controlled system containing the by-pass valve 2. The arrangement of the correction element 5 further behaves according to such a transfer function that the transfer functions of the two controlled systems will be, at least approximately, identical with each other.

The transfer function $F_{KOR}(s)$ of the correction element 5 may be expressed by the formula $$F_{KOR}(s) = \frac{F_1(s)}{F_2(s)} \text{ where } F_1(s) = \frac{Q_1(s)}{x_1(s)} \text{ and } F_2(s) = \frac{Q_2(s)}{x_2(s)}.$$

$F_1(s)$ represents the transfer function of the controlled system which contains the turbine intake valve 1, with $x_1$ representing the regulating value which acts within the controlled system. $F_2(s)$ represents the transfer function of the controlled system which contains the by-pass valve 2, with $x_2$ representing the regulating value acting within this controlled system. $Q_1$ represents the steam flow-through in the turbine intake valve 1, and $Q_2$ represents the steam flow-through in the by-pass valve 2. Finally, s represents the complex variable. After insertion of the dynamic correction element 5, there will apply the formula $$\begin{aligned} Q_2(s) &= x_2(s) \cdot \frac{F_1(s)}{F_2(s)} \cdot F_2(s) \\ &= x_2(s) \cdot F_1(s) \end{aligned} \tag{1.3}$$

By combining the formula (1.3) with the formula (1.2) it follows that $\Delta Q_2(s) = -\Delta Q_1(s)$. Therefore the requirement that $Q_1(t)+Q_2(t)$ be about constant is met.

A practical example of a computed transfer function for the correction element 5 reads as follows:

$$F_{KOR}(s) = \frac{1 + b_1 \cdot s}{1 + a_1 \cdot s + a_2 \cdot s^2} = \frac{1 + 0.425 \cdot s}{1 + 0.216 \cdot s + 0.0083\, s^2}$$

The permissible deviation of the sum $Q_1(t)+Q_2(t)$ from the specified value is usually characterized by a time integral FM of the relative error. The integral is often referred to as flow mismatch and may be characterized as follows:

$$FM = \int_o^T \frac{Q_1(t) + Q_2(t) - Q_0}{Q_0}\, dt$$

with the symbols having the following meaning:

| Symbol | Unit | |
|---|---|---|
| FM | s | flow mismatch |
| T | s | upper limit of integration t which is about equal to the duration of the closing operation by the turbine intake valve 1, or respectively the duration of the opening operation by the valve 2, with the longer time period of either valve inserted as the upper limit; |
| o | s | time "zero", beginning of the closing operation; |
| $Q_1(t)$ | kg/s | variable steam flow through the turbine intake valve 1; |
| $Q_2(t)$ | kg/s | variable steam flow through the by-pass valve 2; |
| $Q_o$ | kg/s | steam flow through the turbine intake valve 1 prior to the closing operation by the turbine intake valve 1 at the time "zero", in this case $Q_2(t)$ equals zero. |

It is stipulated in the case of a practical application that for nuclear reactor plants the time integral FM can not exceed +10% s, preferably not beyond +8% s, nor fall below −4% s, and preferably not below −3% s.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A steam turbine plant comprising:

an intake valve;

a by-pass valve; live-steam generation means for supplying steam to both the intake and the by-pass valves;

regulating circuit means for controlling the opening and closing of both the intake and the by-pass valves in accordance with first and second transfer functions, respectively; and, a correction element for one of the by-pass and the intake valves, said correction element having a transfer function which modifies one of said first and second transfer functions such that the modified transfer function is approximately equal to the other of said first and second transfer functions.

2. The steam turbine of claim 1 wherein the correction element modifies the transfer function relating to the control of the by-pass valve.

3. The steam turbine plant of claim 2 wherein the transfer function of the correction element is denoted $F_{KOR}(s)$ and is characterized as $$F_{KOR}(s) = \frac{F_1(s)}{F_2(s)}$$

$$\text{where } F_1(s) = \frac{Q_1(s)}{x_1(s)} \text{ and } F_2(s) = \frac{Q_2(s)}{x_2(s)}$$

with $F_1(s)$ being the transfer function of the regulating circuit means for controlling the intake valve, $x_1$ being a regulating value of the regulating circuit means for controlling the intake valve, $F_2(s)$ being the transfer function of the regulating circuit means for controlling the by-pass valve, $x_2$ being a regulating value of the regulating circuit means for controlling the by-pass valve, $Q_1$ being the steam flow-through the intake valve, $Q_2$ being the steam flow through the by-pass valve, and (s) being a variable.

4. The steam turbine plant of claims 1, 2 or 3 wherein the transfer function of the correction element provides a time integral FM, where FM is characterized as follows:

$$FM = \int_0^T \frac{Q_1(t) + Q_2(t) - Q_0}{Q_0} dt,$$

to not exceed +10% s and not fall below −4% s, where the symbols in the time integral FM are as follows:

| Symbol | Unit | |
|---|---|---|
| T | s | upper limit of integration t which is about equal to the longer of the duration of [the] a closing operation by the turbine intake valve and the duration of [the] an opening operation by the by-pass valve, with the longer time period of either valve being inserted as the upper limit; |
| o | s | time "zero", the beginning of [the] a closing operation; |
| $Q_1(t)$ | kg/s | variable steam flow through the turbine intake valve; |
| $Q_2(t)$ | kg/s | variable steam flow through the by-pass valve; and |
| $Q_o$ | kg/s | steam flow through the turbine intake valve prior to [the] a closing operation by [this] the turbine intake valve at the time "zero", with $Q_2(t) = 0$. |

5. The steam turbine plant of claim 4 wherein the value of FM does not exceed +8% s and does not fall below −3% s.

6. A control device for a steam power plant, having a by-pass valve and an intake valve comprising:

a correction element for one of the by-pass and the intake valves, said correction element having a transfer function such that the transfer functions of regulating circuits which control the opening and closing of the intake and the by-pass valves, respectively, are approximately equal to one another.

7. The control device of claim 6 wherein the correction element is connected to the regulating circuit for controlling the by-pass valve.

8. The control device of claim 7 wherein the transfer function of the correction element is denoted $F_{KOR}(s)$ and is characterized as $$F_{KOR}(s) = \frac{F_1(s)}{F_2(s)}$$

$$\text{where } F_1(s) = \frac{Q_1(s)}{x_1(s)} \text{ and } F_2(s) = \frac{Q_2(s)}{x_2(s)}$$

with $F_1(s)$ being the transfer function of the regulating circuit for controlling the intake valve, $x_1$ being a regulating value of the regulating circuit for controlling the intake valve, $F_2(s)$ being the transfer function of the regulating circuit for controlling the by-pass valve, $x_2$ being a regulating value of the regulating circuit for controlling the by-pass valve, $Q_1$ being the steam flow through the intake valve, $Q_2$ being the steam flow through the by-pass valve, and (s) being a variable.

9. The control device of claims 6, 7 or 8 wherein the transfer function of the correction element provides a time integral FM, where FM is characterized as follows:

$$FM = \int_0^T \frac{Q_1(t) + Q_2(t) - Q_0}{Q_0} dt,$$

to not exceed +10% s, and not fall below −4% s, where the symbols in the time integral FM are as follows:

| Symbol | Unit | |
|---|---|---|
| T | s | upper limit of integration t which is about equal to the longer of the duration of [the] a closing operation by the turbine intake valve and the duration of [the] an opening operation by the by-pass valve, with the longer time period of either valve inserted as the upper limit; |
| o | s | time "zero", the beginning of [the] a closing operation; |
| $Q_1(t)$ | kg/s | variable steam flow through the turbine intake valve; |
| $Q_2(t)$ | kg/s | variable steam flow through the by-pass valve; and |
| $Q_o$ | kg/s | steam flow through the turbine intake valve [1] prior the [the] a closing operation by the turbine intake valve at the time "zero", with $Q_2(t) = 0$. |

10. The control device of claim 8 wherein the value of FM does not exceed +8% s and does not fall below −3% s.

11. A method of controlling a steam turbine plant having an intake valve and a by-pass valve, comprising the steps of:

generating a first signal for controlling the intake valve in accordance with a first transfer function;

generating a second signal for controlling the by-pass valve in accordance with a second transfer function; and modifying one of said first and second control signals such that the resulting transfer function relating to the modified control signal is approximately equal to the transfer function relating to the other of said first and second control signals.

12. The method of claim 11 wherein said second control signal is the modified signal.

* * * * *